US005444874A

United States Patent [19]

Samelian et al.

[11] Patent Number: 5,444,874

[45] Date of Patent: Aug. 29, 1995

[54] EASY ACCESS HAND COVERING

[76] Inventors: John K. Samelian, 920 Rae Ct., Mendota Heights, Minn. 55118; Jennifer Walsh, 8635 Woodclift Rd., Bloomington, Minn. 55438

[21] Appl. No.: 200,494

[22] Filed: Feb. 23, 1994

[51] Int. Cl.[6] ..... A41D 19/00

[52] U.S. Cl. ..... 2/159; 2/162; 2/917

[58] Field of Search ..... 2/158, 159, 160, 161.7, 2/161.6, 162, 16, 161.1, 161.4, 917, 910; 602/21, 22, 62, 64; 128/879

[56] References Cited

U.S. PATENT DOCUMENTS

| | | | |
|---|---|---|---|
| 428,115 | 5/1890 | Levy | 2/158 |
| 480,852 | 8/1892 | Kahn | 2/158 |
| 1,310,120 | 7/1919 | Kreamer | 2/158 |
| 1,361,565 | 12/1920 | Christy . | |
| 2,270,363 | 1/1942 | Weeber | 2/159 |
| 2,318,785 | 5/1943 | Kopplin | 2/158 |
| 2,323,136 | 6/1943 | Johanson | 2/158 |
| 2,549,660 | 4/1951 | Buhe et al. | 2/159 |
| 2,743,453 | 5/1956 | Singer | 2/158 |
| 3,369,258 | 2/1968 | Smith | 2/159 |
| 3,430,265 | 3/1969 | Mazza | 2/162 |
| 3,588,917 | 6/1971 | Antonious | 2/161.1 |
| 3,600,715 | 8/1971 | Perrella | 2/162 |
| 4,040,126 | 8/1977 | Cecil | 2/161 A |
| 4,400,831 | 8/1983 | Rietz | 2/161 A |
| 4,559,647 | 12/1985 | Smith et al. | 2/170 |
| 4,615,049 | 10/1986 | Samelian | 2/163 |
| 4,698,851 | 10/1987 | Dunford et al. | 2/169 |
| 4,701,963 | 10/1987 | Overton | 2/161 A |
| 4,791,683 | 12/1988 | Agee | 2/161.8 |
| 4,805,242 | 2/1989 | Bolton | 2/160 |
| 5,052,057 | 10/1991 | Fetner | 2/158 |
| 5,328,449 | 7/1994 | Andrews et al. | 2/161.7 |

FOREIGN PATENT DOCUMENTS

| | | | |
|---|---|---|---|
| 1482070 | 4/1967 | France | 2/159 |
| 2529760 | 1/1984 | France | 2/159 |
| 669607 | 9/1935 | Germany | 2/158 |
| 388837 | 3/1933 | United Kingdom | 2/158 |
| 2084856 | 4/1982 | United Kingdom | 2/159 |

*Primary Examiner*—C. D. Crowder
*Assistant Examiner*—Amy B. Vanatta
*Attorney, Agent, or Firm*—Jacobson & Johnson

[57] ABSTRACT

A hand covering that uses three temporarily securable flaps on its back portion to provide for the extremely easy ingress and egress of a hand while allowing the invention to remain positioned securely upon the wrist throughout, the hand covering having palm, back, and finger portions in the general manner of a standard mitten or glove, the back portion having a first and second flap opposite one another to grip the user's wrist, and a third flap, which normally covers an exit hole for the hand, located opposite the more fingerward end of the second flap, and connecting to the second flap; when the user desires to extract his or her hand from the glove, he or she need only perform a metacarpel flexion motion with the hand and pull upon the finger portion, causing the second and third flaps to unfasten, and creating an automatic point of egress for the hand, the first flap, not affected by the action in the knuckle region, remaining securely fastened to the lower, wristward portion of the third flap, and therefore providing a consistent grip upon the wrist throughout the process of egress; manner of ingress being simply the reverse.

13 Claims, 2 Drawing Sheets

EASY ACCESS HAND COVERING

FIELD OF THE INVENTION

This invention relates generally to hand coverings and more specifically to improvements in general purpose hand coverings that permit a person with a disability to have easy access to the hand covering, and that permit persons without disabilities to temporarily remove a hand from the hand covering while maintaining the hand covering secured to the user's wrist.

BACKGROUND OF THE INVENTION

There is a need for multi-purpose easily accessible and removable hand coverings both for persons with and without disabilities. For those people with disabilities the donning of a glove or mitten may be difficult; and for people with or without disabilities, the presence of the glove inevitably reduces the dexterity of the hands. Thus, for on-the-job purposes, sporting, leisure activities such as house and lawn care,, or even childcare, a glove or mitten is generally desired which can be quickly and easily removed and can then be just as easily replaced upon the hand to preserve its warmth.

Previous mitten and glove inventions have employed a number of different means to satisfy this desire. Some allow the user to open the mitten at the finger-tip end, pull the mitten back, and thereby provide the fingers access to the open environment, while conveniently maintaining a connection between the glove and wrist. Other designs have focused on allowing the user to split the glove in some fashion where it connects around the wrist, and thus to gain convenient entry and exit from the glove as a whole.

The present invention allows the user to pull his or her hand through an opening in the back of the glove without removing the glove, thereby freeing his or her fingers entirely, and maintains a hold on the user's wrist, providing the opportunity to readily replace the glove. The present invention also provides ergonomic ease in removing the hand from the glove by allowing the user not only to remove the glove by pulling his or her hand through a hole in its rear portion, but to do it simply by pulling down on the fingertip portions of the glove while performing a metacarpel flexion motion with rite hand located in the glove.

The present invention is useful for children because it is easy for a child, a child care taker, a nursery school teacher or a parent to place on a child's hand. In addition because the person can remove his or her hand from the mitten while still maintaining the mitten on the user's wrist it is ideally suited for small children. A further advantage of the present invention is that it provides an instructional advantage; because the child sees where the fingers or thumbs need to be placed. In addition the glove can be opened up and dried quickly, an important feature for children who often get their mittens wet.

BRIEF DESCRIPTION OF THE PRIOR ART

U.S. Pat. No. 4,615,049 shows an easy access hand covering comprising four finger stalls and a thumb stall attached to a front portion, and a hingedly connected back portion with Velcro edging for securing the back portion to the front portion. The glove is designed specifically for persons with disabilities and has a back open formed by a single flap with an extension. The glove does not provide for removal of the hand from the glove while maintaining the glove secured to the wrist.

U.S. Pat. No. 2,270,363 shows a glove comprising palm, back, and finger portions that cover the hand from the wrist-line forward, where a large portion of the back is cut out to form a large back opening, thereby defining two symmetrical side flaps that extend across the back of the hand just past the wrist inwardly towards each other, and are connected by a detachable device located on the ends of the flaps.

U.S. Pat. No. 3,430,265 shows a glove construction comprising palm, back, and finger portions and having a slit cut in the back portion along an axis parallel with respect to the fingers that is bordered by two Velcro strips located along the slit opposite one another, and having an elastic tightening means along the bottom- or wrist-end of the palm side.

U.S. Pat. No. 3,588,917 shows a golf glove comprising palm, back, and finger portions and having a long slit cut in the back along an axis parallel with respect to the fingers that is bordered by one or two Velcro fasteners comprising two Velcro strips each located along the slit opposite one another, and having a retainer means for holding a ball marker, and having in the palm and rear portions a pattern of perforations. U.S. Pat. No. 3,600,715 shows a golf glove comprising palm, back, finger, and wrist portions having a slit cut in the back along an axis parallel with respect to the fingers that is bordered by Velcro fasteners, and having elastic portions located on the back portion arranged along multiple axes, as well as an elastic band around the wrist portion.

U.S. Pat. No. 4,040,126 shows a golf glove comprising palm, back, and finger portions having a slit cut in the back along the axis parallel with respect to the fingers, and having a Velcro receiving pad mounted on the thumb-side of the back portion next to the slit, and having a Velcro fastener attached at the side of the glove, where the front and back portions meet below the pinky finger. U.S. Pat. No. 4,040,831 shows a glove arrangement for water skiing comprising palm, back, finger portions, the palm portion having an elongated strapping positioned along an axis parallel with the fingers which from the wrist, along the palm, and along the palm-side of the center three finger portions. The palm-side strapping contains a protuberance at the second finger joint location along its length, and the strapping is connected at the wrist end to a wrist strapping which circles the wrist and is fastened at its ends by Velcro.

U.S. Pat. No. 428,115 shows a typical mitten that permits external access for a portion of the fingers of the user while the mitten is retained on the user's hand. The mitten comprises palm and back portions with an opening at its outer end bordered by a frame and having a lock, with the opening occurring along the seam between the front and back portions and the front portion hinging along an imaginary axis extending along the location of the palmside of the first finger joints.

U.S. Pat. No. 480,852 shows a mitten comprising palm and back portions with a slit cut into the palm portion along an axis parallel to the longitudinal direction of the fingers, and having a spring-operated slit closure device placed inside the mitten along the slit.

U.S. Pat. No. 2,743,453 shows a foundryman's glove comprising palm and back portions, with the front portion having protection material against extreme heat, and the back providing by way of a leather cross strap, a permanently open gap, and a wrist band, the means for removing a hand from the glove.

U.S. Pat. No. 2,323,136 shows a mitten having a body portion with individual enclosures for the thumb and forefinger, and a hood section which envelopes the body portion, and is attached substantially along the finger line.

U.S. Pat. No. 5,052, 057 shows an adjustable child's glove that wraps around a moving or closed child's hand to secure it inside with the help of a Velcro enclosure. U.S. Pat. No. 4,701,963 shows a glove having a padded palm, cut off finger stalls, and a wrist grip which can be tightened and then secured by means of two Velcro strips.

U.S. Pat. No. 3,569,258 shows a glove with wrap-around fastening means containing no finger stalls, a tailored palm section, and wrap-around flaps which secure the glove by meeting and re, sting upon the opisthenar.

U.S. Pat. No. 4,698,851 shows a ski glove that has no finger stalls, and comprises palm and opisthenar portions which combine to form a mitten-like shell that can be used to cover a conventional glove configuration.

U.S. Pat. No. 1,310,120 shows a standard mitten with a transverse palmside orifice for extraction of the hand.

U.S. Pat. No. 1,361,565 shows a mitten fastener comprising a wrist band and a connecting strap secured to the wrist band.

U.S. Pat. No. 4,559,647 shows a convertible garment comprising scarf, cuff, and or mitten portions, all being interchangeable in terms of configuration. The mitten comprises opisthenar and palm portions, the opisthenar portion being longer and capable of wrapping around the end of a hand and connecting with the palm portion.

U.S. Pat. No. 2,318,785 shows a standard mitten with a zipper extending from the base of the thumb on the opisthenar side, along the index finger, and ending at the tip of the second, or middle finger.

U.S. Pat. No. 2,549,660 shows a child's glove comprising either or glove or mitten having a zipper located along the minimus side of the hand, running approximately from the wrist region to the end of the minimus finger.

BRIEF SUMMARY OF THE INVENTION

The present invention is a hand covering that uses temporarily securable flaps on its back portion that are openable to provide for the extremely easy ingress and egress of a hand into the glove and a back flap openable independent of the other flaps to allow the invention to remain positioned securely upon the user's wrist as the fingers and the hand are drawn through the opening formed by opened flap. The hand covering has palm, back, and finger portions in the general manner of a standard mitten or glove, the back portion having, however, a first and second flap opposite one another to grip the user's wrist, and a third flap, which normally covers an exit hole for the hand, located opposite the more fingerward end of the second flap, and connecting to the second flap. When the user desires to extract his or her hand from the glove, he or she need only open the third flap and perform a metacarpel flexion motion with the hand while pulling on the finger portion. The first flap, because it is not affected by the action in the knuckle region, remains securely fastened to the lower, wristward portion of the second flap, and therefore provides a consistent grip upon the wrist throughout the process of egress. The manner of ingress is simply the reverse except the user grasps the wrist portion of the glove rather than the fingertips. The present invention, therefore, uses a three-flap structure, to provide on-the-go egress and ingress possibilities, while holding the hand covering throughout securely at the wrist. The glove also allows a person with a disability to use the glove since all three flaps can be opened to permit easy access to the finger and thumb stalls of the glove.

DESCRIPTION OF THE PREFERRED EMBODIMENT

Figure 1:
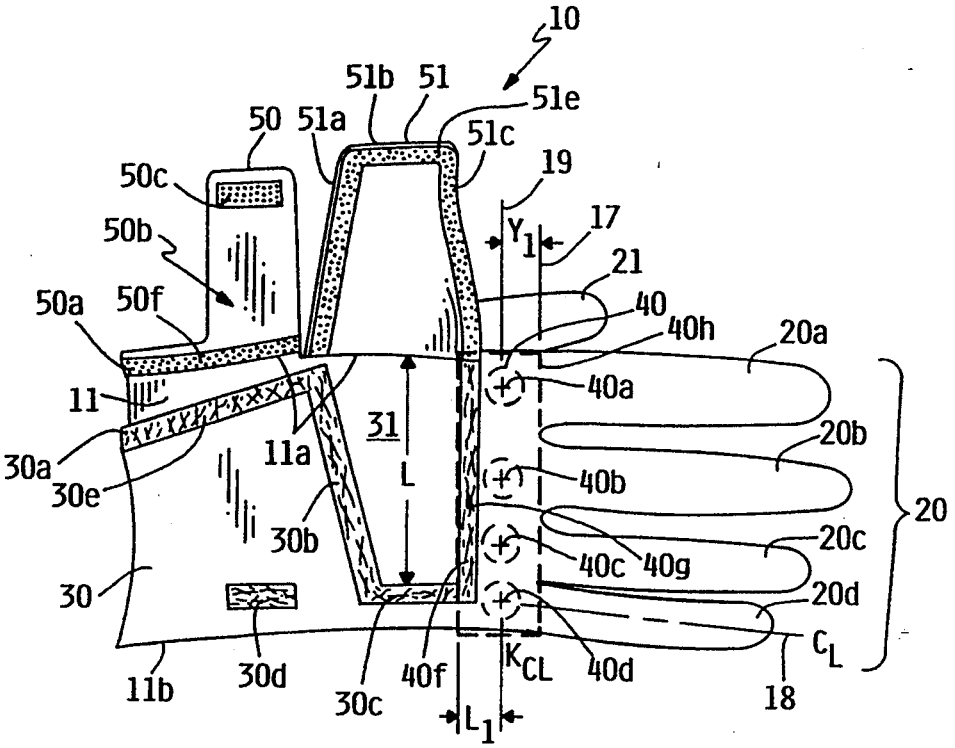
FIG. 1 is a top view of the easy access glove of my invention.

Referring to FIG. 1, reference numeral 10 generally identifies the hand covering of the present invention that permits a user easy hand access thereto, and permits a user to temporarily and quickly extract a hand from the hand covering while retaining the hand covering secured to the corresponding wrist. The hand covering 10 includes a finger portion 20 having finger stalls 20*a*, 20*b*, 20*c*, and 20*d* for covering the user's fingers and a thumb stall 21 for covering the user's thumb. Connected to finger portion 20 is a thumb and palm portion 11 for covering the thumb and palm of the user's hand. Located on the back portion of hand covering 10, and connected to finger portion 20, is a rectangular shaped knuckle portion 40 for covering the user's first knuckles. A first foldable flap 50, comprising a first flap base fastening region 50*a* and a first flap extension 50*b*, and a second foldable flap 51 are hingedly connected to a thumbward edge 11*a* of thumb and palm portion 11. A third foldable flap 30 is hingedly connected to a second edge 11*b* of thumb and palm portion 11. First foldable flap 50 and second foldable flap 51 are shown in the open position while flap 30 is shown in the normally closed but unsecured condition.

Finger portion 20 comprises a plurality of finger stalls 20*a*, 20*b*, 20*c* and 20*d* which are joined at the base to one edge of knuckle region 40. While individual finger stalls are shown, the finger stalls could in an alternate embodiment be formed into a single stall large enough for receiving all the user's fingers.

Knuckle region 40 comprises a generally rectangular and elongated region joined on one side to the base of the finger stalls and having an opposite side with an edge 40*f* having a first temporary fastener means 40*g* proximate edge 40*f*. The ends of knuckle region 40 are integrally secured to thumb and palm portion 11 to maintain the shape integrity of the finger portion of hand coveting 10.

Figure 2:
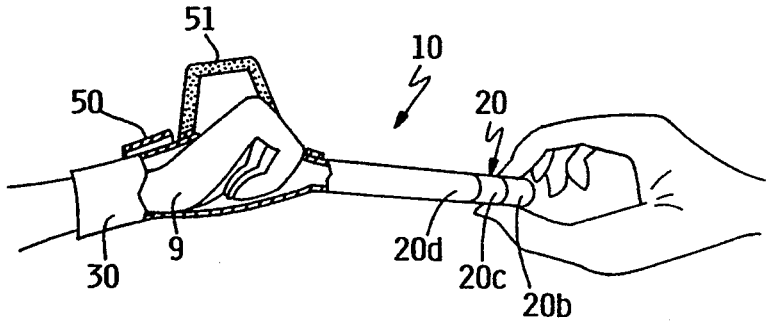
FIG. 2 is a side partial cut away view of the operation of my invention.

Back flap or third flap 30 hingedly connects to thumb and palm portion 11 along minimus edge 11*b* with the opposed extended edge 30*a* containing a first temporary fastener means 30*e*, 30*b* and 30*c* proximate the edge 30*a*. Back flap 30 is integrally connected to knuckle region 40 along a portion of edge 40*f* immediately wristward of the minimus knuckle. This connection creates a normal closed position for back flap 30, as shown in FIG. 1. Located on back flap 30 is a further first temporary fastener means 30*d* for securing the first flap thereto. The edge 30*b* of flap 30 coacts with edge 40*f* to form a trapezoidal shaped opening 31 that is temporarily covered by flap 51. Opening 31 extends a distance L from edge 11*a* to edge 30*a* of flap 30. A center fine designated by $C_L$ extends along finger stall 20*d*. In order to permit removal of glove in an on-the-go basis with most materials as shown in FIG. 2, the distance L should extend proximate the center line 18 to permit the little finger to be withdrawn from the finger stall 20*d* while flaps 30 and 50 are secured to each other. If the material of the glove is more resilient, the distance L could be less. Conversely, if the glove is less resilient, the distance L should be greater to permit free removal of the user's hand by performing a metacarpel flexion motion with the hand while retaining the glove on the user's wrist. While the opening has been described as trapezoidal other shape openings could be used with my invention. For example, for smaller mittens a semi- circular opening and semi-circular flap may be more useful.

First foldable flap 50 is generally L-shaped, and has a temporary fastener means 50*f* located along the first flap base fastening region 50*a* for engaging first temporary fastener means 30*e* on back flap 30 to form a closed collar around a user's wrist. In order to prevent the temporary fasteners 50*e* and 30*f* from accidently pulling free from each other, the first flap extension 50*b* includes a temporary fastener means 50*c* for temporarily engaging fastener 30*d* to securely hold the hand covering around the wrist of the user.

Second flap 51 has a first edge 51*a*, a second edge 51*b*, and a third edge 51 c containing a first temporary fastener means 51 e for securing flap 51 to temporary fastener means 30*b* and 30*c* located along edge 30*a*, and to the temporary fastening means 40*g* on knuckle region 40.

FIG. 2 is a partial cut away view illustrating how the hand can be removed from the hand covering of the present invention while maintaining the collar grip of the hand covering upon the user's wrist. In order to remove the user's hand from the hand covering, the user opens flap 51 and then performing a metacarpel flexion motion with the hand which withdraws the fingers from the finger stalls 20 while holding the finger stalls 20 with the opposite hand This action allows the fingers to be withdrawn from the finger stalls without having to slip the hand covering off the user's wrist. In order to permit this manner of removal, the knuckle portion has a first edge 40*h* adjoining the finger portion to maintain the shape integrity of the hand covering, and a second edge 40*f* for engaging the second flap 51, with the edge 40*f* extending a distance $L_1$ from a center line 19 extending through the apexes of knuckle region which are identified by reference numerals 40*a*, 40*b*, 40*c* and 40*d*. Edge 40*f* extends sufficiently far so as to completely cover the user's knuckles but not so far as to impede the withdrawal of the user's hand by performing a metacarpel flexion motion with the hand while the user's hand is located in the hand covering. Typically, the distance $L_1$ denoted in FIG. 1 is on the order of one half inch. However, the distance will vary in accordance with the materials used. That is, a nonresilient material with little stretchability will require that the distance $L_1$ be fairly dose to the apex line 19 in order for a person to withdraw his or her hand by performing a metacarpel flexion motion with the hand in the glove. On the other hand, if the material is resilient and has more stretchability, the distance $L_1$ could be larger since the stretching of the material would aid in the withdrawal of the user's hand. In any event, the knuckle portion has sufficient width so as to integrally hold the finger stalls in a contiguous section and to extend over the apex of the knuckles so as not to create a pressure point along the apex of the knuckles.

Figure 3:
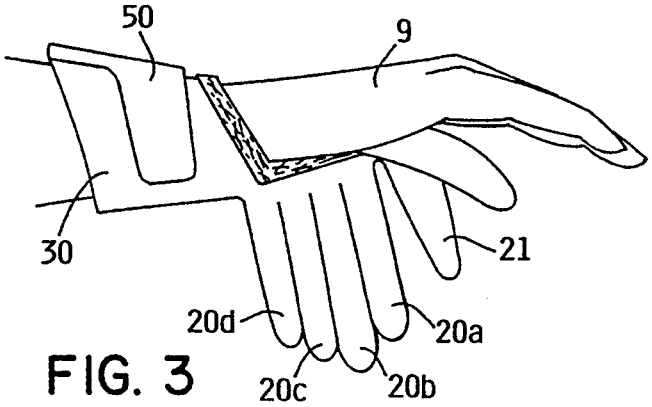
FIG. 3 is a side perspective view of my invention upon a user's hand.

FIG. 3 illustrates how the user's hand is free of the hand covering while the hand covering 10 is maintained in a secured relationship around the user's wrist by the coaction of flaps 50 and flap 30. In this condition the user is free to use his or her hand while maintaining the glove in position to allow quick insertion into the glove.

The temporary fastener means 30*a*, 30*d* and 40*g* may be loop type material and the temporary fastener means 50*d*, 50*c* and 51*e* may be hook type material which secures itself of the loop material by contact therewith. Such material is typically sold under the tradename VELCRO. While hook and loop flexible fabric fasteners are shown other temporary fastener means could be used with our invention. For example, snaps or other connectors could be used.

Figure 4:
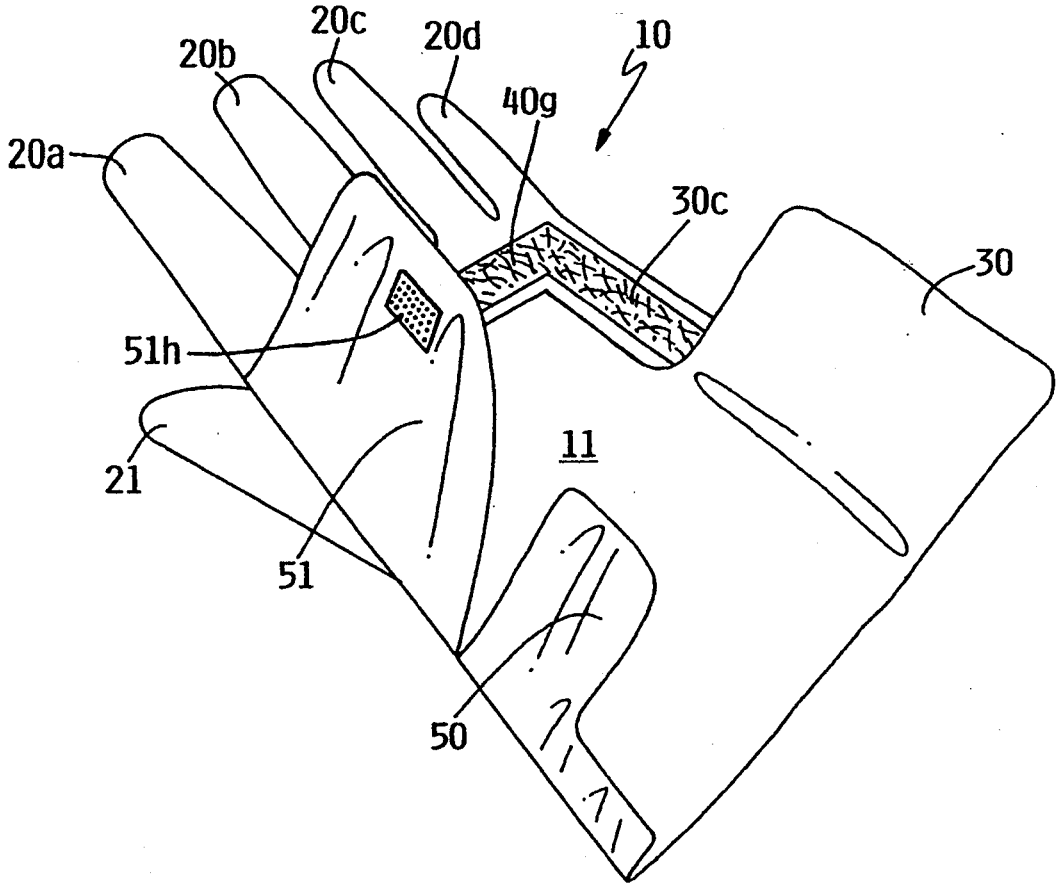
FIG. 4 is a perspective view of the back of glove of FIG. 1 showing the flaps in an open position to permit the easy entry of a user's hand into the finger and thumb stalls of the glove.

Referring to FIG. 4, our glove 10 is shown in the open position with flaps 51, 50 and 30 extending upward to permit insertion of a user's fingers into the finger stalls 20*a*, 20*b*, 20*c*, and 20*d* as well as permit insertion of a user's thumb into thumb stall 21. With the flaps fully opened our glove is ideally suited for use by per:sons with disabilities who have difficulties donning or removing a glove. In addition the glove is useful for those who do not have disabilities but want to be able to remove or don the glove while on-the-go. It should be pointed out that while the invention is shown with a glove it is also suitable for use with mittens and particularly suitable as a child's mitten. For example, a parent may take a child shopping which requires the child to go from a colder environment to a warmer and then back to a colder environment. Since the mitten can be maintained on the child's wrist, it remains in a position that allows one to quickly place the mitten on the child's hand prior to the child going into the colder environment. For small children the first flap base region fastener means 50*f* may be eliminated since the extra holding force provided by the temporary fastener means on the base region may not be needed. In addition the second flap 50 may be merged into the thumb and palm portion so that fastening means 50*a* is the means for holding the glove as a unit. Another feature of the ability to open the glove is that enables one to more quickly dry the glove since one obtains access to the interior of the glove.

The back side of flap 51 may contain a temporary fastening means 51*h* for securing with a mating temporary fastener means (not shown) on the opposite side of glove 10 to permit the flap 51 to be held in a folded back out-of-the-way position as the user manipulates his or her hand through the opening 31 in the back portion of glove 10.

We claim:

1. A hand coveting to permit a user easy hand access thereto and to permit a user to temporarily and quickly extract a hand from the hand covering while retaining the hand covering secured to a wrist of the user comprising:

a finger portion for covering the user's fingers;

a thumb and palm portion connected to said finger portion for covering the thumb and palm portion of a user's hand, said thumb and palm portion having a first edge and a second edge;

a knuckle portion connected to said finger portion, said knuckle portion normally covering the knuckles of a user when the user's fingers are located in said finger portion;

a first foldable flap hingedly connected to said first edge of said thumb and palm portion, said first flap foldable between an open condition and a closed condition;

a second foldable flap adjacent said first foldable flap, said second foldable flap hingedly connected to said first edge of said thumb and palm portion, said second flap foldable between an open condition and a closed condition; and a third foldable flap hingedly connected to said second edge of said thumb and palm portion,said third foldable flap foldable between an open condition and a closed condition, said first foldable flap and said third foldable flap securable to each other when in a closed condition to retain the hand covering on a user, while the second foldable flap can be maintained in an open condition to form a hand opening to permit extension of a user's hand therethrough by the user performing a metacarpel flexion motion with the hand to withdraw the user's fingers from the finger portion of the hand covering.

2. The hand covering of claim 1 wherein said knuckle portion has a first edge for adjoining said finger portion and a second edge for engaging said second flap with an apex region for extending over the top of a user's knuckles located between said first edge for adjoining said finger portion and said second edge for engaging said second flap.

3. The hand covering of claim 2 wherein said knuckle portion second edge extends sufficiently far so as to completely cover the user's knuckles but not so far as to impede the withdrawal of the user's hand by performing a metacarpel flexion motion with the hand while the user's hand is located in the hand covering.

4. The hand covering of claim 3 wherein said knuckle portion has sufficient width so as to integrally hold said finger stalls in a contiguous section.

5. The hand coveting of claim 4 wherein said third flap has a second edge, a third edge, and a fourth edge with temporary fasteners located there along to permit said second flap to be temporarily secured to said first flap.

6. The hand covering of claim 5 wherein said knuckle portion includes fastening means for temporarily securing a portion of said second flap thereto.

7. The hand covering of claim 1 wherein said first foldable flap has a first edge so that when said first :foldable flap is in a closed condition, said first foldable flap is located entirely on the wrist region of a user to permit the bending of the user's hand without affecting the position of the hand covering on the user's hand.

8. The hand coveting of claim 1 wherein said second foldable flap and said third foldable flap form an opening that extends from said first edge of said palm and thumb portion sufficiently far so as to permit removal of all the fingers from said finger portion by the user curling the fingers of hand inside said hand covering and pulling lightly upon the finger portion.

9. The hand covering of claim 5 wherein said second flap and said third flap extend toward each other with a portion of said third flap having means for engaging a portion of said second flap to hold said flaps proximate each other.

10. A hand coveting to permit a user easy hand access thereto and to permit a user to extract the user's hand from the hand covering while on-the-go while retaining the hand covering secure, d to a wrist of the user comprising:

a finger portion for covering the user's fingers;

a thumb and palm portion connected to said finger portion for covering the thumb and palm portion of a user's hand, said thumb and palm portion having a first edge and a second edge;

a knuckle portion connected to said finger portion, said knuckle portion normally covering the apex of knuckles of a user when the user's fingers are located in said finger portion;

a first foldable flap hingedly connected to said first edge of said thumb and palm portion, said first foldable flap foldable between an open condition and a closed condition;

a second foldable flap adjacent said first foldable flap, said second foldable flap hingedly connected to said first edge of said thumb and palm portion, said second foldable flap foldable between an open condition and a closed condition; and a third foldable flap hingedly connected to said second edge of said thumb and palm portion, said third foldable flap foldable and said knuckle region cooperating to form an opening therebetween which is large enough for a user's hand to extend therethrough when said third foldable flap is in a dose condition, said third foldable flap and said second foldable flap having temporary fastening means for being temporarily secured to each other to secure the hand covering to the wrist of a user to permit the hand covering to be worn and secured thereto when the hand of the user is not located in the hand coveting.

11. The hand covering of claim 10 wherein the opening formed by said third foldable flap and said knuckle region extends substantially to a center line extending though a finger stall for the pinky finger of the user's hand.

12. The hand covering of claim 10 wherein an edge of the knuckle portion extends approximately one half inch beyond a center line extending through the apex of the knuckle portion of said hand coveting.

13. A hand covering to permit a user easy hand access thereto and to permit a user to extract the user's hand from the hand covering while on-the-go while retaining the hand covering secured to a wrist of the user comprising:

a finger portion for covering the user's fingers;

a thumb and palm portion connected to said finger portion for coveting the thumb and palm portion of a user's hand, said thumb and palm portion having a first edge and a second edge;

a knuckle portion connected to said finger portion, said knuckle portion normally covering the apex of knuckles of a user when the user's fingers are located in said finger portion;

a first foldable flap, said first foldable flap foldable between an open condition and a closed condition;

a second foldable flap adjacent said first foldable flap said second foldable flap foldable between an open condition and a closed condition; and a further portion connected to said thumb and palm portion, said further portion and said knuckle region cooperating to form an opening therebetween which is large enough for a user's hand to: extend therethrough when said second foldable flap is in an open condition, said further portion and said second foldable flap having temporary fastening means for being temporarily secured to each other to secure the hand coveting to the wrist of a user to permit the hand covering to be worn and retained when the hand of the user is not located in the hand covering.

* * * * *